US007140945B2

(12) United States Patent
Dinhofer

(10) Patent No.: US 7,140,945 B2
(45) Date of Patent: Nov. 28, 2006

(54) GYRATING TOY

(76) Inventor: Jay B. Dinhofer, 60-T Corbin Ave., Bay Shore, NY (US) 11706

( * ) Notice: Subject to any disclaimer, the term of this patent is extended or adjusted under 35 U.S.C. 154(b) by 0 days.

(21) Appl. No.: 10/690,960

(22) Filed: Oct. 23, 2003

(65) Prior Publication Data

US 2005/0087547 A1 Apr. 28, 2005

(51) Int. Cl.
*A63H 3/46* (2006.01)

(52) U.S. Cl. ..... 446/378; 446/97; 446/309; 446/486

(58) Field of Classification Search ..... 446/311, 446/486, 308–312, 378–380, 97
See application file for complete search history.

(56) References Cited

U.S. PATENT DOCUMENTS

| | | | | | |
|---|---|---|---|---|---|
| 202,990 | A * | 4/1878 | Chinnock | 446/311 |
| 842,659 | A * | 1/1907 | Haverman | 446/310 |
| 2,224,456 | A * | 12/1940 | Janas | 446/300 |
| 2,446,540 | A * | 8/1948 | Leach | 446/310 |
| 2,760,303 | A * | 8/1956 | Del Mas | 446/97 |
| 2,776,525 | A * | 1/1957 | Ford | 446/199 |
| 2,901,862 | A * | 9/1959 | Thomas | 446/185 |
| 3,108,395 | A * | 10/1963 | Goldfarb | 446/311 |
| 3,176,431 | A * | 4/1965 | Richardson et al. | 446/343 |
| 3,501,861 | A * | 3/1970 | Goldfarb et al. | 446/177 |
| 3,581,434 | A * | 6/1971 | Fels | 446/309 |
| 4,093,198 | A * | 6/1978 | Petersen | 267/179 |
| 4,114,306 | A * | 9/1978 | Molenaar | 446/486 |
| 5,727,984 | A * | 3/1998 | Lin | 446/431 |
| 6,482,071 | B1 * | 11/2002 | Wilgosz | 446/486 |
| 2002/0164921 | A1 * | 11/2002 | Wilkinson et al. | 446/308 |

* cited by examiner

*Primary Examiner*—Bena Miller

(57) ABSTRACT

An action toy consisting of a vertically mounted compression spring with a weighted top, and a means for preventing the base of the spring from bouncing away from the surface on which it is standing when the spring is compressed and released. The invention includes weighted projections extending horizontally and attached just below the top of the spring and clamps or weights on the base. It also includes a spring adjustment means on the base, a means of imbedding the ends of the springs, a means of indexing the top weight and the base weight with reference to each other and finger grips on the base. A piping of light weight non-attenuating material can be snaked around the coiled spring. A closure is added to the base and a filament is attached between the top of the spring and the base.

5 Claims, 4 Drawing Sheets

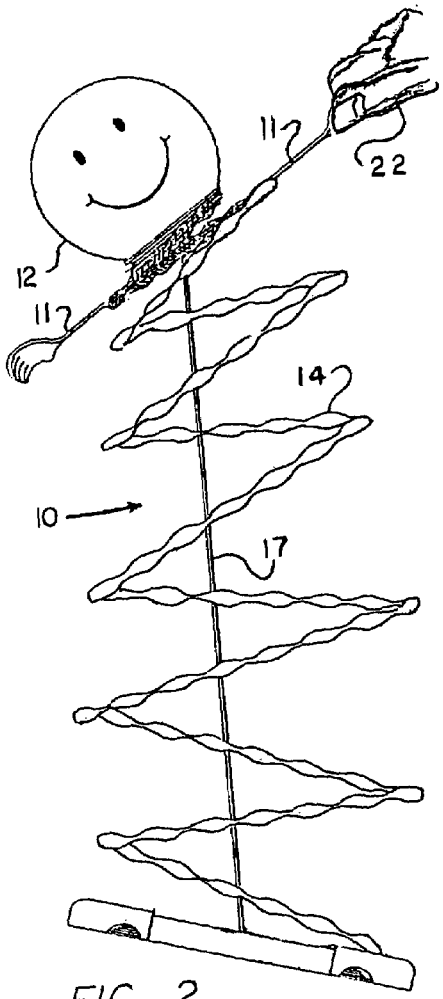
FIG. 2
FIG. 3
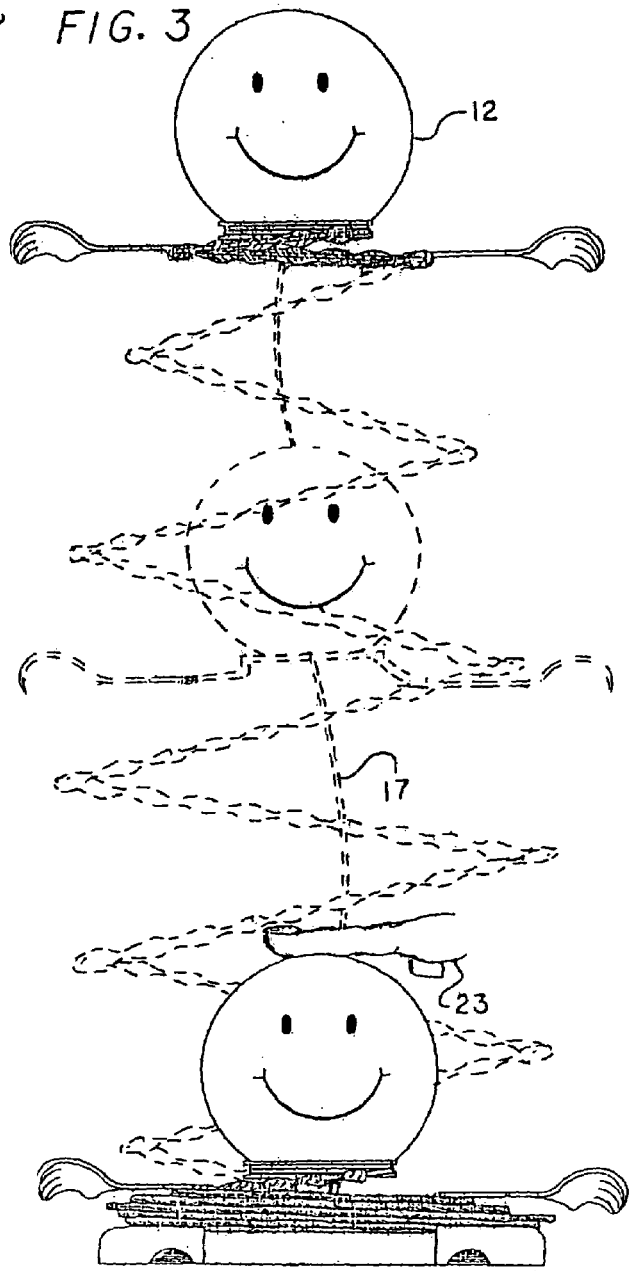

FIG. 4
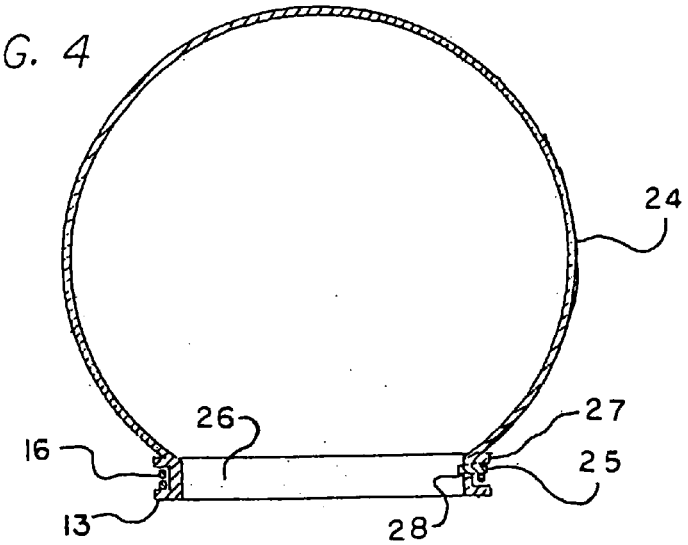
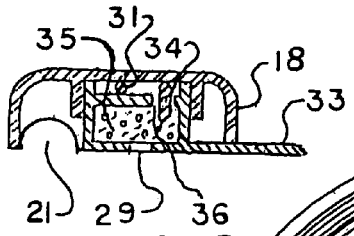
FIG. 6-6
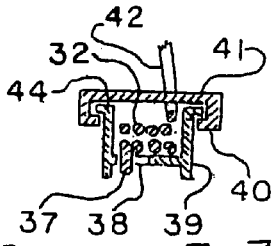
FIG. 7-7
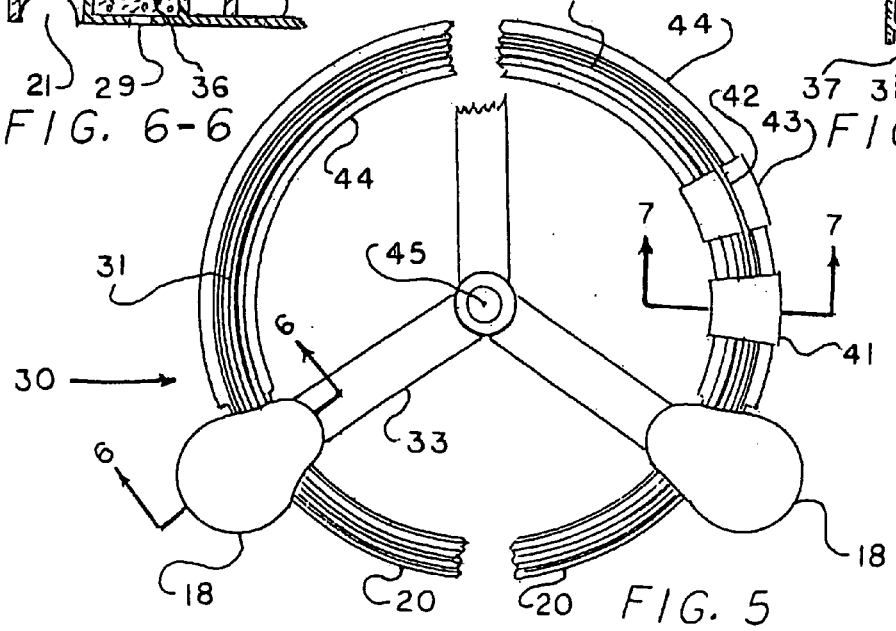
FIG. 5

FIG. 8
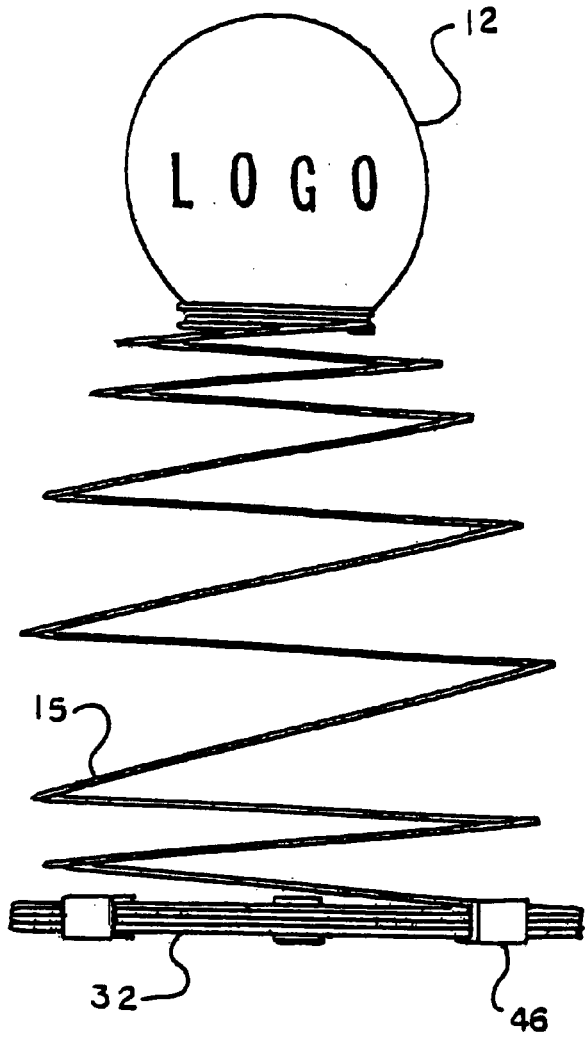
FIG. 9
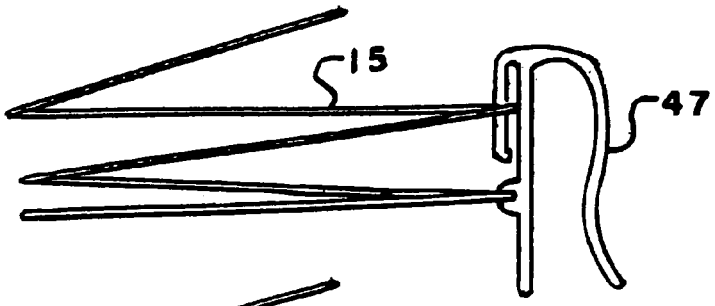
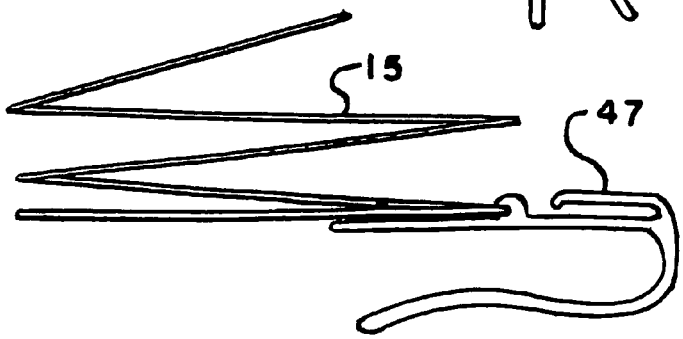
FIG. 10

GYRATING TOY

BACKGROUND OF THE INVENTION

1. Field of Invention

This invention relates to a toy depending on the action of a compression spring when compressed by added weight and external pressure in particular to a spring where the force of the spring and the added weight on top of the spring give the spring a long slow period, one full cycle, and a seemingly perpetual gyrating and/or bouncing motion. To the adult user it is educational, relaxing and pleasing. When doll like features are added to the weights, the base and the other controlling parts the entire unit reverts to a fascinating, bouncing, belly laughing doll appealing to children of all ages. In both forms it can be used for advertising purposes or as a decoration.

2. Description of Prior Art

Springs as a support and a means of dampening bouncing weights go back to the discovery of steel. However, all patents applied for were either for dampening devices, such as shock absorbers, door operators or pop-up devices such as Jack-in-the-Boxes. There apparently was no need for industrial devices utilizing a free gyrating and bouncing motion. Toys and amusement devises on the other hand tried to evolve into the gyrating and bouncing motion but failed.

One of the earliest spring action toys was a pop-up as shown and described in U.S. Pat. No. 202,990 issued Apr. 30, 1878 to C. E. Chinnock for a Jumping Toy the spring of which was compressed into a pneumatic device that delayed pop up. To escape the pneumatic control the spring had to be heavy duty causing the base to leave the ground when activated and this along with the friction of the clothing covering the spring made this a one shot deal with no gyration.

The next spring action toy is shown and described in U.S. Pat. No. 1,276,224 issued Aug. 20, 1918 to J. Isaacs for a Figure Toy in which a heavy duty compression spring mounted to a base has attached to the top of it an extra heavy weight head with a full body that entirely covers the spring. The Head is depress and released. The weight of the head makes it a projectile with the sole purpose of propelling the spring and its base off the ground and have the base make a noise when it lands. The weight of the head, the heavy duty spring required, the friction of the body cover and the raising of the base off the ground all make this a one shot pop-up action with no gyration.

Another such spring body toy is shown and described in U.S. Pat. No. 2,224,456 issued Dec. 10, 1940 to M. M. Janas for a Toy Doll where the spring is used to allow manual manipulation, stretching and bending, of the body, which then slowly returns to its original shape due to the resilient memory of the spring. There is no gyration.

The first of many spring mounted hobbyhorses as shown and described in U.S. Pat. No. 2,452,869 issued Nov. 2, 1948 to D. L Richards for a Hobbyhorse where the child sits on the horse and rocks back and forth. The strength of the spring necessary to support a child prevents bouncing. Over the years the chain legs where replace by an every increasingly stronger, stiffer, heavy spring and sometimes concealed guides that limited rocking such as shown and described in U.S. Pat. No. 4,093,198 issued Jun. 6, 1978 to T. L Petersen for a Coil Spring Device.

'Rapid vibrating motion' was achieved as shown and described in U.S. Pat. No. 2,464,665 issued Mar. 15, 1949 to G. Anderson for a Spring Supported Figure where a spring, loosely wound encompasses a light weight figure and is hung from a stand. The weight of the spring extends it downwards simulating a cage. Any force applied to the spring causes it to 'vibrate'. This indicates an extremely light weight figure, almost weightless, and a fairly heavy duty spring which causes rapid slight oscillations (vibrations). The spring is an extension spring, not a compression spring. The spring used in a Slinky is an extension spring. If the base of the spring is set upon a table and the top released, the top will settle down completely around the figure with the coils making very close contact with each other. The spring cannot be compressed. The spring action only works when the device is hung or held from the top.

A compression spring, vertically mounted, is shown and described in U.S. Pat. No. 2,901,862 issued Sep. 1 1959 to N. Thomas for an Articulated Toy which consists of a standing doll with head mounted on top of the spring and with feet mounted on the base of the spring and arms pivotally mounted to the base of the head and holding a glass of beer. The doll is fully clothed. When you press down on the dolls head he lowers the glass of beer. When you release the dolls head he raises the beer to his mouth. Gyration is not a factor in this patent.

A compression spring, vertically mounted, is shown and described in U.S. Pat. No. 3,176,431 issued Apr. 6, 1965 to D. W. Richardson for a Resilient Action Figure Toy in which a vertically standing compression spring has weightless 'simulated facial characteristics' attached to the front of the spring and weightless simulated feet attached to the bottom of the spring. Because this spring as shown is basically just a spring it will just pop-up into the air at an angle and in combination with the facial features attached to the front of the spring unbalancing it, it will fall over before it oscillates. The inventor, therefore, made claim to a modified spring with a 'lower helical' spring that has a lower center of gravity, with a 'larger relative diameter' and flat base with an attached upper 'relatively smaller diameter' helical spring. The action of these two springs connected as described goes against Newton's Laws of Motion and Hooke's Law. Hooke's law $F=-kX$ states that these two springs can never oscillate in unison at the same cycle and will fight each other. Newton's Law of action and reaction states that the opposing oscillations will balance each other out, the larger lower spring almost instantly consuming all the kinetic and potential energy of the smaller upper spring. The upper spring will never oscillate or sway independently. It will vibrate a few times and stop becoming an excessive dead weight. The bottom spring with its low center of gravity and heavier spring wire with a wider diameter base and an excessively heavy head will be unable to sway horizontally or maintain a vertical oscillation for any 'prolonged periods of time' as claimed. Also depriving it of the ability to oscillate for any prolonged period of time is the low profile of the spring with the coils very close together. The low profile helical shape does not allow one to depress it enough to give it the necessary energy it requires, and the spring with its flat base will still jump off the ground at an angle dissipating immediately what little energy is put into the action.

A compression spring, vertically mounted, is shown and described in U.S. Pat. No. 3,501,861 issued Mar. 24, 1970 to A. E. Goldfarb for a Game Apparatus And Time-Delayed Action Unit in which a head with suction cup is attached to the top of the spring but the spring sits on a base to which it is not attached. The suction cup is pressed against the base and slowly releases causing the head and the spring to pop-up. No gyration is involved. The reason for including this patent in our search documents is that from this patent evolved the ubiquitous wobbly-headed figures for which apparently no patent was ever issued. If a patent where issued it would indicate a concealed, lengthy, stiff spring which simply allows the head to wobble back and forth and not up and down and requiring continuous activation such as a bouncing car.

In a gyrating toy of the present invention the safety features of assembling the spring to the weights, the safety features in operation, the durability of its construction, the utilizing of the weights and spring in accordance with Newton's and Hooke's Laws to obtain a vastly longer duration of gyration with a slower, higher and more pleasing cycle as opposed to a vibration, the stability of the toy when standing alone, the ease of production, the aesthetics of the toy and/or of the doll enable the toy to be used safely, easily and enjoyably by both adult and child.

SUMMARY OF THE INVENTION

It is an object of the present invention to provide an action toy consisting of a compression spring of any length and diameter, set in a vertical, upright position, with weighted appendages applied centrally to the top and the bottom of the spring and taking into account Newton's Laws of Motion and Hooke's Law for springs in order to obtain the maximum duration and length of vertical traverse of the spring at a slow cycle (period) of oscillations and 360 degree back and forth, side to side gyrations, the described action of the spring and appendages giving the appearance of a person enjoying a prolonged belly laugh. Hooke's Law places springs in two categories, k small (ks) and k large (kl), this device depending on ks springs, s standing for thin wire, more flexible springs as opposed to kl springs, l standing for heavy wire, stiffer, less flexible ones. The weight of the top appendages must be such that when attached they depress the spring approximately 5% or more from its static equilibrium. The desirable weight of the top appendages must also be such that when the spring is depressed and suddenly released its upward inertia will extend the spring 20% or more above its static equilibrium. For maximum storage of energy and more stable operation the distance between each coil of the spring should be approximately 10 times or more than the diameter of the spring wire and the height of the cumulative coils approximately 1 to 3 times the diameter of the base. The weights applied to the base must be heavy enough that when pressure is applied straight downward to the weighted top of the spring depressing it and then the pressure is suddenly released and the spring shoots straight up the base does not leave the ground and the spring does not bounce up at an angle unless so directed by pushing or tapping the weighted spring at an angle. If the base leaves the ground Newton's Law of action and reaction takes effect where the base absorbs the kinetic and potential energy of the spring and diminishes the duration of gyration or stops it completely. There are several methods of increasing the weight of the base. One is, while producing the spring, to continue coiling the base of the spring with a number of additional coils, 4 or more, wound parallel and in contact with each other, dead coils, and then compacting the cluster of coils with metal or plastic clips. Another method is to fill a retaining ring with plaster of paris or the like before attaching the spring. The horizontally extended upper appendages serve as stabilizers, similar to those used by tightrope walkers, to maintain balance and control the sideways gyrations. In the case of the doll the horizontal appendages are shaped like arms, a shoulder at one end and curved, grasping hands at the other end so a child can hold the hands or lift the doll by the hands without pulling them off the spring. Attached to the retaining ring on the base are finger grips for holding the toy with your fingers and applying a slight rhythmic up and down motion which will start the gyration and maintain it in varying degrees of intensity as long as you maintain the rhythm of the spring and in varying degrees of intensity. The finger grips on the doll are shaped like feet. The finger grips also serve to lock the spring to the base. Also locking the bottom of the spring to the base, are sliding clips which clip to the base where the spring exits the base. When assembled in production or after extended use the spring, when in static equilibrium, may not stand erect. It may tilt in any direction. By sliding the clips along the base and under or over the spring where it exits the base they can redirect the spring to vertical. The top end of the spring ends in one flat coil snuggly encircling the neck of the upper weight and then extending out past the flange. Approximately 3/16 of an inch of the cut end of the spring at the top is indented or bent at a 90° degree angle in-wards towards the center. Approximately 3/16 of an inch of the cut end at the bottom of the spring is indented or bent at a 90 degree angle down-wards. The relative position of theses ends must be maintained at all times and used as a means of indexing the upper weight with the lower weight making it possible for the dolls face to always face in the same direction as the feet point. The neck of the upper weight has an inward directed indent into which the bent end of the spring enters and engages. The base ring has a downward directed indent into which the bent end of the spring enters and engages. These bent ends of the spring not only lock the head and the feet in position but also imbed the ends of the spring in a manner which prevents them from being exposed and causing harm to the user.

It is a principle object of this invention to provide a new and improved lifelike bouncing, gyrating action toy.

The present invention provides a new and improved method of matching the weight added to the top of a spring, the (k) of the spring, and a means of preventing the base of the spring from jumping off the ground giving the spring maximum bounce and the ability to oscillate and gyrate at a slow cycle for an extremely long duration when activated.

The invention provides an improved means for obtaining the maximum vertical transverse up and down motion for the spring.

This invention also allows for activating the toy while it is sitting on a stationery platform or held in the hand.

This invention also provides a means for maintaining the spring of the toy in a proper vertical position, not drooping, when not in use or just before starting it up.

This invention provides balancing horizontal stabilizers at the top that prevent destabilizing gyrations.

This invention provides a means for preventing a child from placing the spring over his head and becoming entangled in it.

This invention provides a means for preventing the spring from overextending itself.

According to this invention all the means provided for operating the toy can be redesigned making the toy into a new and improved gyrating action doll.

A new and improved gyrating action doll which when gyrating as invented has the appeal of a bouncing, belly laughing individual appealing to children of all ages.

Various modification and changes may be made in the illustrated structures without departing from the spirit and scope of the present invention. For example, the size, shape or configuration of the body may be altered, as may that of the weighted base and the added weights at other locations.

As another example, an electric relay or electric motor might be installed at the base of the spring to supply the necessary motion for operation. In view of my disclosure others skilled in the art will doubtless try to obtain all or part of the benefits of my invention without copying the structure shown, and I therefore claim all such in so far as they fall within reasonable spirit and scope of my claims.

BRIEF DESCRIPTION OF THE DRAWINGS

FIG. 2 is a view of the filament stretched when the doll is lifted.

FIG. 3 is a view of the doll compressed downwards.

FIG. 4 is cross-section of the head attached to the spring.

FIG. 5 is a top view of the base.

FIG. 6 shows a cross-section of an indented wire through hole.

FIG. 7 is a cross-section of dead coils and a sliding clip on flanges.

FIG. 8 shows the doll uncovered.

FIG. 9 is a means for clipping the doll.

FIG. 10 shows the clip in a horizontal position.

DETAILED DESCRIPTION OF THE INVENTION

Figure 1:
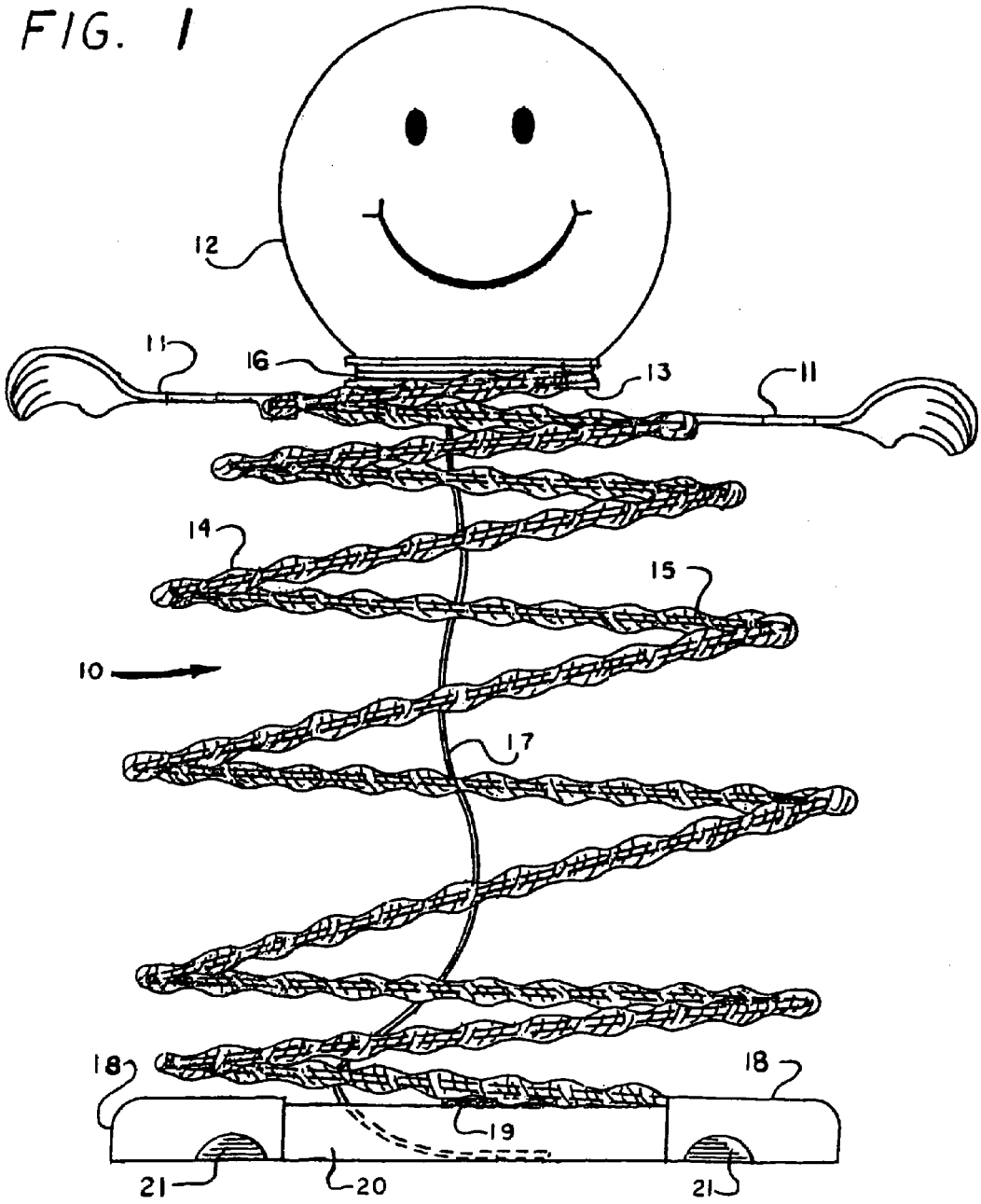
FIG. 1 is depiction of the doll at rest.

FIG. 1 shows details of a spring activated bouncing gyrating toy generally designated 10 comprising a compression spring of both a helical and conical configuration 15 covered with a light weight piping 14 in static equilibrium. A weighted element in the shape of a dolls head 12 attached centrally to the top of the spring and held there by the flange 13 and the tightly coiled spring 16. Two stabilizers 11 in the shape of shoulders arms and hands extend from each side of the top coils of the piping 14 covered spring 15. The base of the spring enters an enclosure 20, attached to the enclosure is a sliding clip 19, a pair of permanent clips 18 shaped like feet with finger grip cutouts 21. A slack filament 17 attaches to the top weight and the bottom weight.

FIG. 2 shows the toy being lifted off the ground by a hand 22 holding the stabilizer 11, the filament 17 is stretched to its limit preventing the spring from over extending.

FIG. 3 shows the toy in action being pressed down from its static equilibrium position shown in FIG. 1 to its maximum energy position by a finger 23. When it is released, it accelerates upwards and comes to rest at its apogee and accelerates downwards to its perigee. The filament 17 is always slack.

FIG. 4 shows a hollow cross-section of the top weight 24 with upper flange 27 and lower flange 13 holding the coiled spring 16 in position. The indented end of the spring 25 located between the flanges locks into the hole 28 between the two flanges.

FIG. 5 is a top view of the retaining ring enclosure 20, the ring is split at the top and the bottom in order to show two different methods of weighting the base. The left half 31 shows the base when weighted with plaster of paris, the right half 32 shows the base weighted with dead coils. The cross-section 6—6 shown in FIG. 6—6 is through the foot shaped 18 finger grip and the cross hatched 33 base closure. The cross-section 7—7 is through the sliding clip 41 that slides over the spring 42 where it exits the base, the cross hatched base closure 33 connects in a Y with two other cross hatches, at the center is a hole 45 for attaching the filament 17.

FIG. 6—6 shows only one or two coils of spring 31 in a shallow channel, the spring being locked in place by the slotted 21 finger grip 18. The finger grip 18 is sitting on top of the cross-hatch closure 33. The indented end of the spring 34 locks into the hole 36 in the enclosure ring, the base of the ring is filled with plaster of paris 35 through a hole 29.

FIG. 7—7 shows eight or more dead coils 32 in a deep channel 39 the spring being held in place by the finger grip 18 and the sliding clips 41 and 43, the indented end of the spring 37 locks into the hole 38 in the enclosure ring, the sliding clips 41 and 43 are held in place by the flange 40 on the clip and the flange 44 on the enclosure ring. Flange 44 runs around the outside and inside top edges of the enclosure ring.

FIG. 8 shows a basic spring activated toy 30, consisting of an upper weight 12 with an advertising LOGO, the compression spring 15, a dead coil base 32 and 3 retaining clips 46.

CLAIMS PREAMBLE

Compression springs used for the amusement of children have a long history. Efforts to make a vertical compression spring oscillate failed because the spring would jump off the surface on which it was standing. This had several effects. First the base of the spring would oscillate upwards causing the top of the spring to lose its downward force. Oscillations would cease immediately. Second, compression springs when compressed and released never push up equally around the entire base. The end of the coil closest to the supporting surface, no matter how arranged, will always push up before the rest of the base causing the spring to pitch over and fall on its side. Oscillations would then again cease immediately. Weights also were added, indiscriminately, on the side of the spring unbalancing it. This also caused it to pitch over. To prevent this an attempt was made to use a relatively much larger diameter helical spring. The diameter of the spring wire was also increased to add weight to hold the spring down and the coils were wound closer together so the spring could not jump as high. These modifications froze the action of the spring preventing it from oscillating. To overcome this an excessively heavy weight was added to the top of the spring to get it to compress. The result was more of a minimal motion or rapid vibration than an oscillation and the base of the spring still jumped up and down away from the supporting surface. These modifications again bringing even a minimal motion to a rapid end.

Therefore I claim as my invention:

1. A bouncing, gyrating toy doll consisting of a conical shaped compression spring including a spring wire with a circular cross-section having a small diameter top end and a large diameter bottom end, a weighted doll head having a neck, a weighted base having feet and horizontal extended arms having hands, said spring further includes a plurality of light weight coils, said weighted doll head is connected to the small diameter top end of the conical spring, the large diameter bottom end of the conical spring is connected to the weighted base and the arms is connected horizontally to an upper part of the spring wherein the conical shaped spring stands freely upright.

2. The bouncing gyrating toy doll of claim 1, wherein the small diameter circular cross-section of the spring wire allows the spring to be compressed completely downward with a minimum pressure to a top portion of the doll head and when released the wire imparts a slow cycle and long traverse to the spring when oscillating.

3. The bouncing gyrating toy doll of claim 1 further includes a weight attached to the base wherein the weight keeps the spring leveled and upright when not in motion and when the spring is released, the base prevents the spring from bouncing from a surface on which the toy stands.

4. The bouncing gyrating toy doll of claim 1 further includes a clamping means hinged to the base of the toy wherein the clamping means enables the toy to maintain an upright operating position when clamped to a vertical surface.

5. The bouncing gyrating toy doll of claim 1 further includes a filament connected between the doll head and the base to prevent the spring from stretching beyond a tensile limit.

* * * * *